US008172874B2

(12) United States Patent
Randolph et al.

(10) Patent No.: US 8,172,874 B2
(45) **Date of Patent: *May 8, 2012**

(54) NIPPLE

(75) Inventors: Ross Steven Randolph, Rockaway, NJ (US); Charles John Renz, Briarcliff Manor, NY (US); John George Rousso, Trumbull, CT (US); Brenda O'Grady Liistro, Westport, CT (US)

(73) Assignee: Playtex Products, Inc., Westport, CT (US)

( * ) Notice: Subject to any disclaimer, the term of this patent is extended or adjusted under 35 U.S.C. 154(b) by 1288 days.

This patent is subject to a terminal disclaimer.

(21) Appl. No.: 11/205,720

(22) Filed: Aug. 17, 2005

(65) Prior Publication Data

US 2005/0277987 A1 Dec. 15, 2005

(51) Int. Cl.
*A61J 17/00* (2006.01)

(52) U.S. Cl. ..... 606/236; 215/11.5

(58) Field of Classification Search ..... 606/234–236; 215/11.1–11.6; D24/193–197
See application file for complete search history.

(56) References Cited

U.S. PATENT DOCUMENTS

| | | | | |
|---|---|---|---|---|
| 956,741 | A | 5/1910 | Smith | |
| 1,099,082 | A | 6/1925 | Decker | |
| 1,541,330 | A | 5/1932 | Decker | |
| 1,858,356 | A | 5/1932 | Brown | |
| 2,196,870 | A | 4/1940 | Little | 128/252 |
| D130,791 | S | 12/1941 | Porthouse et al. | |
| 2,269,223 | A | 1/1942 | Porthouse et al. | 128/252 |
| 2,366,214 | A | 1/1945 | Ramaker | 128/252 |
| 2,509,129 | A | 5/1950 | Buck | 215/11 |
| 2,588,069 | A | 3/1952 | Allen | 128/252 |
| 2,741,385 | A | 4/1956 | Raiche | 215/11 |
| 2,960,088 | A | 11/1960 | Witz | |
| 2,977,013 | A | 3/1961 | Clemens | 215/11 |
| 3,203,569 | A | 8/1965 | Shomock et al. | 215/11 |
| 3,211,315 | A | 10/1965 | Griesinger | 215/11 |
| 3,272,202 | A | 9/1966 | Soto | 128/252 |
| 3,664,535 | A | 5/1972 | Mette | 215/11 |
| 3,677,429 | A | 7/1972 | La Barge | 215/11 |
| 3,777,753 | A | 12/1973 | Kesselring et al. | 128/252 |
| 4,238,040 | A | 12/1980 | Fitzpatrick | 215/11.3 |

(Continued)

FOREIGN PATENT DOCUMENTS

AU 111441 7/1991

(Continued)

OTHER PUBLICATIONS

Canadian Office Action dated Jul. 20, 2010 from corresponding Canadian Patent Application No. 2,503,447.

(Continued)

*Primary Examiner* — Kevin T Truong
(74) *Attorney, Agent, or Firm* — Ohlandt, Greeley, Ruggiero & Perle, L.L.P.

(57) ABSTRACT

A nipple simulating the shape, surface geometry and function of a woman's breast is provided. The nipple has a stem and a base. The base has an areola region and a bulbous region. The areola region is positioned between the stem and the bulbous region, and can simulate the areola of a woman's breast. The bulbous region can simulate the region of a woman's breast surrounding the areola. The areola region has a texture or surface geometry that is different from the texture or surface geometry of the stem or bulbous region.

39 Claims, 5 Drawing Sheets

U.S. PATENT DOCUMENTS

| | | | | | |
|---|---|---|---|---|---|
| D264,380 | S | | 5/1982 | Chrones | |
| D271,797 | S | | 12/1983 | Chrones | D24/196 |
| 4,505,398 | A | | 3/1985 | Kesselring | 215/11.5 |
| D286,071 | S | | 10/1986 | Fuller | D24/46 |
| D288,240 | S | | 2/1987 | Fuller | D24/46 |
| D288,241 | S | | 2/1987 | Fuller | D24/46 |
| 4,676,386 | A | | 6/1987 | Phlaphongphanich | 215/11 |
| D294,735 | S | | 3/1988 | Morano et al. | D24/196 |
| D300,462 | S | | 3/1989 | English et al. | D24/45 |
| 4,834,099 | A | | 5/1989 | Schrooten | 128/360 |
| D303,839 | S | | 10/1989 | Fitzpatrick et al. | D24/194 |
| 5,024,341 | A | | 6/1991 | Dekerle | 215/11.1 |
| 5,101,991 | A | | 4/1992 | Morifuji et al. | 215/11.1 |
| 5,129,532 | A | | 7/1992 | Martin | 215/11.1 |
| D330,938 | S | | 11/1992 | Sakashita | D24/196 |
| 5,269,426 | A | | 12/1993 | Morano | 215/11.6 |
| 5,419,445 | A | | 5/1995 | Kaesemeyer | 215/11.1 |
| D360,468 | S | | 7/1995 | Fuller | D24/196 |
| 5,544,766 | A | * | 8/1996 | Dunn et al. | 215/11.1 |
| 5,553,726 | A | | 9/1996 | Park | 215/11.4 |
| 5,617,972 | A | | 4/1997 | Morano et al. | 221/33 |
| D381,752 | S | | 7/1997 | McCoy | D24/196 |
| 5,653,732 | A | | 8/1997 | Sheehy | 606/236 |
| 5,747,083 | A | | 5/1998 | Raymond et al. | 426/117 |
| 5,806,711 | A | | 9/1998 | Morano et al. | 221/33 |
| D405,530 | S | | 2/1999 | Manganiello et al. | D24/196 |
| 5,878,899 | A | | 3/1999 | Manganiello et al. | 215/11.6 |
| 5,881,893 | A | | 3/1999 | Manganiello | 215/11.5 |
| D411,886 | S | | 7/1999 | Manganiello | D24/197 |
| 5,921,426 | A | | 7/1999 | Randolph | 220/495.06 |
| D412,582 | S | | 8/1999 | Morano | D24/197 |
| D417,275 | S | | 11/1999 | Conforti | D24/130 |
| 6,003,698 | A | | 12/1999 | Morano | 215/11.1 |
| 6,032,810 | A | | 3/2000 | Meyers et al. | 215/11.1 |
| 6,041,950 | A | * | 3/2000 | Soehnlein | 606/234 |
| 6,053,342 | A | | 4/2000 | Chomik | 215/11.5 |
| D433,143 | S | | 10/2000 | Chomik et al. | D24/197 |
| 6,161,710 | A | * | 12/2000 | Dieringer et al. | 215/11.4 |
| D441,086 | S | | 4/2001 | Morano | D24/197 |
| D441,870 | S | | 5/2001 | Randolph | D24/196 |
| 6,241,110 | B1 | * | 6/2001 | Hakim | 215/11.1 |
| 6,253,935 | B1 | | 7/2001 | Fletcher | 606/236 |
| 6,325,817 | B1 | * | 12/2001 | Shen | 606/236 |
| 6,372,234 | B1 | | 4/2002 | Deckers | |
| 6,439,243 | B2 | | 8/2002 | Laughlin | |
| D463,567 | S | | 9/2002 | Morano | |
| D465,028 | S | | 10/2002 | Renz | D24/196 |
| 6,601,720 | B2 | | 8/2003 | Meyers | |
| D479,606 | S | | 9/2003 | Randolph | |
| 6,645,228 | B2 | | 11/2003 | Renz | |
| D488,560 | S | | 4/2004 | Renz | |
| 7,122,045 | B2 | | 10/2006 | Randolph | |
| 2002/0030029 | A1 | | 3/2002 | Hakim | |

FOREIGN PATENT DOCUMENTS

| | | |
|---|---|---|
| CN | 1324230 | 11/2001 |
| CN | 1324423 | 11/2001 |
| EP | 0 009 459 | 4/1980 |
| JP | 56-91555 | 12/1982 |
| JP | 5-37313 | 1/1995 |

OTHER PUBLICATIONS

Supplementary European Search Report dated Sep. 24, 2010 from corresponding European Patent Application No. 02786603.7.
European Examination Report dated Feb. 2, 2011 from corresponding European Patent Application No. 02 786 603.7-1257.
Notice of Reasons for Rejection from corresponding Japanese Patent Application No. 2004-548366 dated Sep. 29, 2010.
Chinese Office Action dated Apr. 24, 2009 from Chinese Patent Application No. 200380102488.9.
Second Notification of Office Action from Chinese Application No. 200380102488.9 dated Apr. 24, 2009.
First Notification of Office Action from Chinese Application No. 200380102488.9 dated Oct. 26, 2007.
Notification of Transmittal of International Preliminary Examination Report from PCT Application No. PCT/US02/34825 dated Sep. 3, 2003.
Notification of Transmittal of the International Search Report or the Declaration from PCT Application No. PCT/US02/34825 dated Apr. 29, 2003.
Notification of Transmittal of International Preliminary Examination Report from PCT Application No. PCT/US03/31902 dated Sep. 13, 2004.
Notification of Transmittal of the International Search Report or the Declaration from PCT Application No. PCT/US03/31902 dated Jul. 16, 2004.
Office Action from Japanese Application No. 2004-019032 dated Nov. 9, 2004 (with English summary).
Decision of Rejection from Japanese Application No. 2004-019032 dated Aug. 16, 2005 (with English summary).
Decision of Rejection from Japanese Application No. 2004-019031 dated Aug. 16, 2005 (English summary ONLY).
Office Action from Japanese Application No. 2004-019030 dated Nov. 9, 2004 (with English summary).
Office Action from Japanese Application No. 2003-030298 dated Mar. 30, 2004 (with English summary).
Final Notice of Rejection from Japanese Application No. 2004-548366 dated Sep. 4, 2009 (English translation of action).
Notice of Reasons for Rejection from Japanese Application No. 2004-548366 dated Oct. 21, 2008 (English translation of action).
Canadian Examination Report from Canadian Application No. 2,503,447 dated Jul. 11, 2011.
Canadian Examination Report from Canadian Application No. 107816 dated Mar. 22, 2005.
Canadian Examination Report from Canadian Application No. 102619 dated Mar. 25, 2004.
Canadian Examination Report from Canadian Application No. 2,503,447 dated Aug. 11, 2009.
Canadian Examination Report from Canadian Application No. 104539 dated Aug. 12, 2004.
Canadian Examination Report from Canadian Application No. 104539 dated Jan. 11, 2005.
Canadian Examination Report from Canadian Application No. 104539 dated Apr. 2, 2004.
Canadian Examination Report from Canadian Application No. 2,446,631 dated May 12, 2008.
Official Action from Mexican Application No. PA/a/2005/004034 dated Jul. 28, 2007 (English translation only).
Official Action from Mexican Application No. PA/f/2003/001182 dated Sep. 4, 2004 (English translation only).
Official Action from Mexican Application No. PA/a/2004/004416 dated May 5, 2011 (English translation only).
Examination Report No. 1 from Australian Application No. 1259-03 dated Jun. 27, 2003.
Examination Report from GB Application No. GB0507717.7 dated Mar. 14, 2006.
Examination Report from GB Application No. GB0507717.7 dated Aug. 7, 2006.
Office Action from U.S. Appl. No. 29/179,840 dated Mar. 9, 2004.
Office Action from U.S. Appl. No. 10/054,510 dated Feb. 6, 2003.
Office Action from U.S. Appl. No. 10/272,475 dated Sep. 18, 2006.
Office Action from U.S. Appl. No. 10/272,475 dated Mar. 21, 2005.
Office Action from U.S. Appl. No. 10/272,475 dated Jan. 4, 2005.
Office Action from U.S. Appl. No. 10/272,475 dated Jul. 8, 2004.
Office Action from U.S. Appl. No. 10/658,308 dated Oct. 23, 2009.
Office Action from U.S. Appl. No. 10/658,308 dated Mar. 17, 2009.
Office Action from U.S. Appl. No. 10/658,308 dated Jul. 1, 2008.
Office Action from U.S. Appl. No. 10/658,308 dated Aug. 2, 2007.
Office Action from U.S. Appl. No. 10/658,308 dated Mar. 7, 2007.
Office Action from U.S. Appl. No. 10/658,308 dated Aug. 3, 2006.
Office Action from U.S. Appl. No. 10/658,308 dated May 24, 2006.
Office Action from U.S. Appl. No. 10/658,308 dated Mar. 15, 2006.
Office Action from U.S. Appl. No. 10/658,308 dated Nov. 30, 2005.
Office Action from U.S. Appl. No. 10/658,308 dated Oct. 17, 2005.
Office Action from U.S. Appl. No. 10/658,308 dated Jun. 3, 2005.
Office Action from U.S. Appl. No. 10/658,308 dated Dec. 13, 2004.

* cited by examiner

NIPPLE

RELATED APPLICATION

This application is a continuation-in-part of copending application Ser. No. 10/054,510, filed Nov. 13, 2001.

CROSS-REFERENCES TO RELATED APPLICATIONS

The present application is claiming priority of U.S. patent application Ser. No. 10/272,475, filed on Oct. 16, 2002, the content of which is herein incorporated by reference.

BACKGROUND OF THE INVENTION

1. Field of the Invention

The present invention relates to baby bottle nipples. More particularly, the present invention relates to baby bottle nipples that simulate a woman's breast.

2. Description of the Prior Art

Baby bottle nipples for feeding babies from bottles are known. Baby bottle nipples allow mothers to bottle-feed their babies as a temporary or permanent alternative to breast-feeding. Babies become accustomed to the shape and function of a woman's breast during breast-feeding. Due to the significant differences in the shape and function between a woman's breast and conventional baby bottle nipples, babies experience difficulty when switching between breast-feeding and bottle-feeding. This can cause a baby to fail to take formula from a baby bottle nipple. Likewise, babies can grow accustomed to the shape and function of a particular conventional baby bottle nipple, creating difficulty for the baby to return to breast-feeding. This can cause a baby to fail to take milk from a woman's breast because of a developed preference for the shape, texture and function of the baby bottle nipple.

In U.S. Pat. No. 5,653,732 to Sheehy, a nipple that claims to have a "natural form" is disclosed. The nipple has an annular rim, a lower segment, an intermediate segment, an upper segment and a tip. The annular rim is used as a securing structure and is adjacent to, and integrally formed with, the lower segment having a large curved outer surface. The lower segment is adjacent to, and integrally formed with, the intermediate segment that has a smaller curved outer surface and is smaller than the lower segment. The intermediate segment is adjacent to, and integrally formed with, the upper segment that has a smaller curved outer surface than the intermediate segment. The upper segment is adjacent to, and integrally formed with, the tip. The disclosed nipple suffers from the drawback of having three segments or areas that do not simulate the shape and function of a woman's breast.

SUMMARY OF THE INVENTION

It is an object of the present invention to provide a nipple that assists babies in switching between breast-feeding and bottle-feeding.

It is another object of the present invention to provide such a nipple with a shape, texture and function simulating a woman's breast.

It is yet another object of the present invention to provide such a nipple that promotes latching on to the areola region of the nipple.

These and other objects and advantages of the present invention are provided by a nipple that has a stem having a stem surface with a stem texture and a base having a base surface with a base texture. At least a portion of the base texture is different from at least a portion of the stem texture. The base texture can be a first texture and a second texture, and the first texture can be disposed between the stem texture and the second texture. The first texture can be different from the stem texture. The first texture can be rough and the stem texture can be smooth. Also, the second texture can be smooth. The stem and the base can be integrally formed from a flexible material. The flexible material can be chosen from the following group of materials: silicone, latex, rubber, or any combinations thereof. The nipple can also have a securing structure attached or connected to the base. The securing structure can be a flange extending outwardly from the base. The stem can be elongated and can be tapered. The first texture can be disposed along the base surface on a substantially circular region. Also, the first texture can be disposed along the base surface on an outwardly curved region.

The present invention is also provided by a nipple that simulates a shape, surface geometry, and function of a woman's breast during breast feeding. The nipple has a stem having a stem surface with a first surface geometry, an areola region having an areola surface with a second surface geometry, and a bulbous region having a bulbous surface with a third surface geometry. The areola region is disposed between the stem and the bulbous region, and the areola region simulates the shape, surface geometry and function of an areola of the woman's breast.

Also, at least a portion of the second surface geometry is different from at least a portion of the first surface geometry. At least a portion of the second surface geometry can be different from at least a portion of the third surface geometry. The second surface geometry can be rough. The first surface geometry can be smooth and the third surface geometry can be smooth. The bulbous region can simulate the shape, surface geometry and function of a region of the woman's breast surrounding the areola. The stem, areola region and bulbous region can be integrally formed from a flexible material. The flexible material can be chosen from the following group of materials: silicone, latex, rubber, or any combinations thereof.

The areola region can have an outwardly curved shape. The areola region can have a radius of curvature of about 0.25 inches to about 0.50 inches. The bulbous region can have an outwardly curved shape. The bulbous region can have a radius of curvature of about 0.25 inches to about 0.75 inches. The nipple can also have a securing structure connected to the bulbous region. The securing structure can be a flange extending outwardly from the bulbous region. The flange can have an annular channel formed therein. The stem can be elongated. The stem can have a length of about 0.50 inches to about 1.25 inches. The stem can also be tapered.

The present invention is further provided by a nipple that has a stem having a stem surface with a first surface geometry, an areola region having an areola surface with a second surface geometry, and a bulbous region having a bulbous surface with a third surface geometry. The areola region is disposed between the stem and the bulbous region, and at least a portion of the second surface geometry is different from at least a portion of the first surface geometry.

Also, at least a portion of the second surface geometry can be different from at least a portion of the third surface geometry. The second surface geometry can be rough. The first surface geometry can be smooth and the third surface geometry can be smooth. The stem, areola region and bulbous region can be integrally formed from a flexible material. The flexible material can be chosen from the following group of materials: silicone, latex, rubber, or any combinations thereof. The areola region can have an outwardly curved shape. The areola region can have a radius of curvature of about 0.25 inches to about 0.50 inches. The bulbous region can have an outwardly curved shape. The bulbous region can have a radius of curvature of about 0.25 inches to about 0.75 inches. The nipple can also have a securing structure attached to the bulbous region. The securing structure can be a flange extending outwardly from the bulbous region. The flange can have an annular channel formed therein. The stem can be elongated. The stem can have a length of about 0.50 inches to about 1.25 inches. The stem can also be tapered.

Other and further objects, advantages and features of the present invention will be understood by reference to the following.

DESCRIPTION OF THE INVENTION

Figure 1:
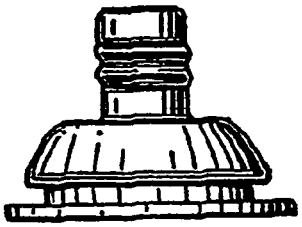
Fig. 1 (PRIOR ART)
FIG. 1 is a plan view of a prior art PLAYTEX® conventional nipple.
Figure 2:
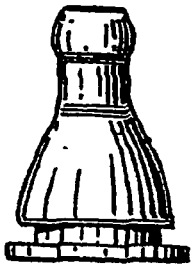
Fig. 2 (PRIOR ART)
FIG. 2 is a plan view of a prior art EVENFLO® conventional nipple.
Figure 3:
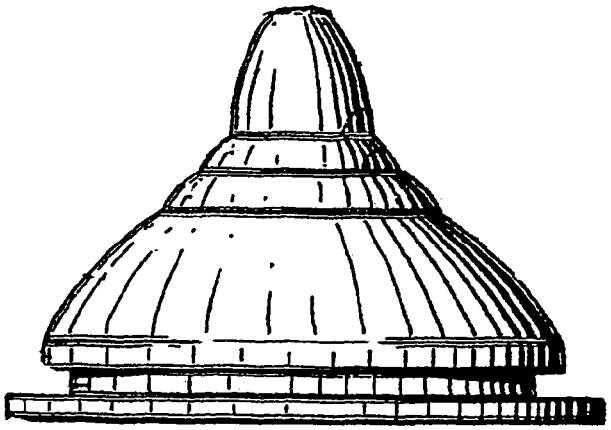
Fig. 3 (PRIOR ART)
FIG. 3 is a plan view of the nipple disclosed in U.S. Pat. No. 5,653,732.

Referring to the drawings and, in particular, FIGS. 1 through 3, there is shown prior art. FIG. 1 is a commercial PLAYTEX® nipple. FIG. 2 is a commercial EVENFLO® nipple. Both of these nipples do not simulate the shape, texture or function of a woman's breast. FIG. 3 is a nipple of U.S. Pat. No. 5,653,732. This nipple has three separate segments and a tip or teat. This prior art nipple fails to simulate the shape, texture or function of a woman's breast.

Figure 4:
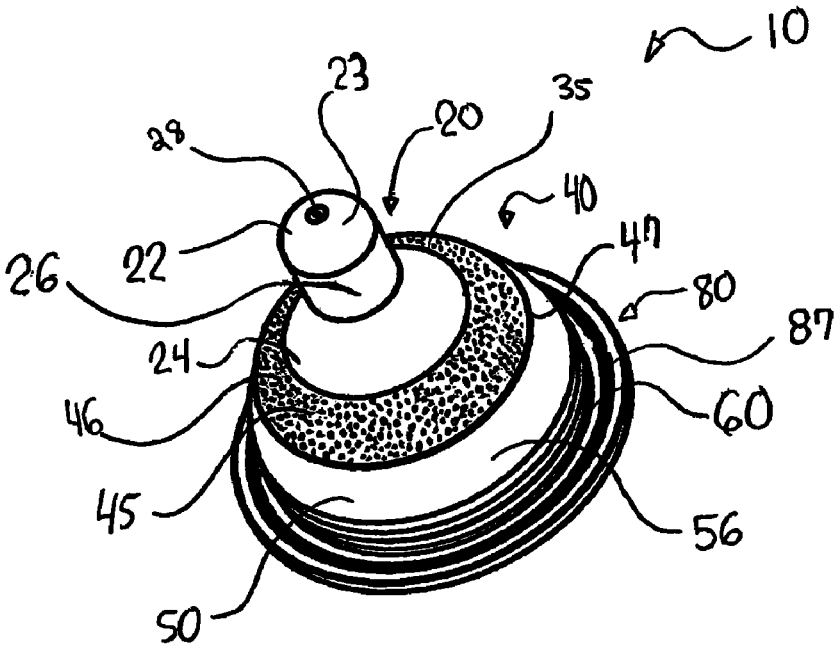
FIG. 4 is a perspective view of the nipple of the present invention.
Figure 5:
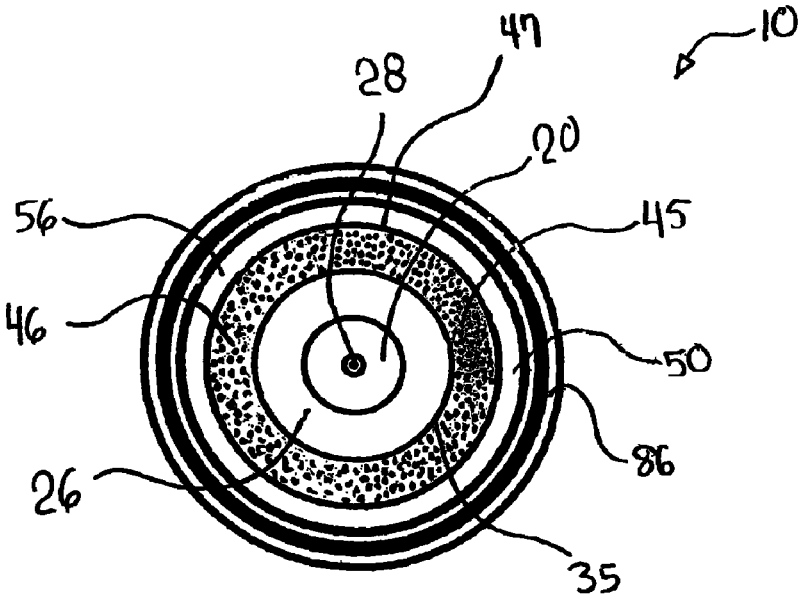
FIG. 5 is a top view of the nipple of FIG. 4.

Referring to FIG. 4, there is shown an embodiment of a nipple of the present invention generally represented by reference numeral 10. Nipple 10 has a stem 20 and a base 40 connected to the stem. Nipple 10 preferably also has a securing structure 80.

Referring to FIGS. 4 through 8, stem 20 has a first end 22, a second end 24, an outer surface 26 and a length L. Base 40 has an areola region 45 with an outer surface 46 and a bulbous region 50 with an outer surface 56.

Stem 20 is substantially cylindrical in shape and is inwardly tapered from second end 24 toward first end 22. Preferably, stem 20 is tapered in the vicinity of second end 24. However, alternative tapering of stem 20 can also be used including tapering over the entire length L of the stem. First end 22 has an outwardly curved apex surface 23. Preferably, apex surface 23 of first end 22 has a radius of curvature of about 0.03 inches to about 0.30 inches. More preferably, apex surface 23 has a radius of curvature of about 0.15 inches to about 0.25 inches.

Second end 24 of stem 20 preferably has an inwardly concave or dish-like, circular shape. Preferably, second end 24 has a radius of curvature of about 0.25 inches to about 0.50 inches. More preferably, second end 24 has a radius of curvature of about 0.30 inches to about 0.40 inches.

The tapered shape of stem 20 towards first end 22 helps promote proper "latch on" by the baby. During breast-feeding, the baby latches on to the areola of a woman's breast. Conventional nipples often promote latching on to the stem by having an indent located along the stem or being of a uniform cylindrical shape, as shown in the prior art of FIGS. 1 through 3. This improper latching on promotes "nipple confusion," i.e., a baby forgets how to properly latch-on to a mother's breast. The present invention provides tapered stem 20 that promotes latching on to areola region 45. The tapered shape of stem 20 causes the baby to slide past the stem and onto areola region 45.

Preferably, first end 22 of stem 20 at its widest point has a diameter of about 0.25 inches to about 0.75 inches, and second end 24 at its widest point has a diameter of about 0.40 inches to about 1.00 inches. More preferably, first end 22 at its widest point has a diameter of about 0.45 inches to about 0.55 inches, and second end 24 at its widest point has a diameter of about 0.55 inches to about 0.65 inches.

The present invention further provides an elongated stem 20. Stem 20 is elongated to simulate the extension of the stem or teat of a woman's breast during breast-feeding, which has a shorter length when not breast-feeding. Preferably, length L is about 0.50 inches to about 1.25 inches. More preferably, length L is about 0.75 inches to about 1.00 inches.

Referring to FIGS. 4 through 10, first end 22 of stem 20 has at least one hole 28 disposed therethrough. Preferably, hole 28 is located at or about the center point of apex surface 23 at first end 22. Hole 28 preferably is an inverted frusto-conical or inwardly tapered channel through stem 20. Hole 28 has a first open end 29 on an upper outer surface 30 of stem 20 and a second open end 31 on an upper inner surface 32 of the stem. First end 29 preferably has a diameter of about 0.01 inches to about 0.05 inches. More preferably, first end 29 has a diameter of about 0.02 inches to about 0.03 inches. Second end 31 preferably has a diameter of about 0.005 inches to about 0.030 inches. More preferably, second end 31 has a diameter of about 0.007 inches to about 0.015 inches.

To provide flexibility to stem 20 while maintaining resiliency to prevent nipple 10 from collapsing during bottle feeding, stem 20 preferably has a wall thickness of about 0.02 inches to about 0.08 inches. More preferably, stem 20 has a wall thickness of about 0.04 inches to about 0.05 inches.

Second end 24 of stem 20 is secured to, and surrounded by, areola region 45 of base 40 along stem edge 35. Preferably, stem edge 35 is circular. Second end 24 is preferably integrally formed with areola region 45 along stem edge 35. Areola region 45 is designed to simulate the areola of a woman's breast. Areola region 45 has an outwardly curved, convex or raised shape providing a raised appearance and feel. This raised appearance and feel allows a baby to latch on to areola region 45 just as a baby would latch on to the areola of a woman's breast during breast-feeding. Preferably, areola region 45 has a radius of curvature of about 0.25 inches to about 0.50 inches. More preferably, areola region 45 has a radius of curvature of about 0.30 inches to about 0.40 inches. Areola region 45 preferably has the same or similar wall thickness as stem 20. More preferably, stem 20 has the same or similar wall thickness as bulbous region 50 in the transition area, i.e., the area where the stem meets the bulbous region. Providing areola region 45 with the same or similar wall thickness as stem 20 and as the transition area of bulbous region 50 reduces or prevents nipple collapse during bottle feeding.

The present invention provides for different textures, surface geometries, and feels for different surfaces of nipple 10. The terms texture, surface geometry and feel include the shape of the surface when viewed parallel to the surface. The terms texture, surface geometry and feel also include different materials, or variations to the properties of a material, to provide a different feel for the baby, such as, for example, hard and soft materials.

Outer surface 46 of areola region 45 has a different texture, surface geometry or feel, on at least a portion thereof, as compared to at least a portion of outer surface 26 of stem 20 and at least a portion of outer surface 56 of bulbous region 50. Preferably, all of outer surface 46 has a different texture, surface geometry or feel than all of outer surface 26 and all of outer surface 56. By providing outer surface 46 with a different texture, surface geometry or feel as compared to outer surface 26 and outer surface 56, the baby receives a signal for latching on and also receives a grip for latching on. Preferably, outer surface 26 and outer surface 56 have a smooth texture, surface geometry or feel, while outer surface 46 of areola region 45 has a rough texture, surface geometry or feel. By providing outer surface 26 of stem 20 with a smooth texture, as well as tapering the stem, the baby will more easily slide down the stem and onto areola region 45 for proper latch on.

Outer surface 46 can have alternative textures or surface geometries including dimples, ribs or other non-smooth textures. Also, areola region 45 with outer surface 46 can be a different material than stem 20 with outer surface 26 and bulbous region 50 with outer surface 56, such as, for example, the stem and bulbous region can be silicone and the areola region can be a plastic, such as, for example, a thermoplastic elastomer (TPE). Additionally, outer surface 46 can be a different material than the rest of nipple 10, such as, for example, molding nipple 10, including outer surfaces 26 and 56, with silicone or another material that is different from TPE, and over-molding TPE on outer surface 46.

Preferably, the texture, surface geometry or feel of outer surface 46 and the texture, surface geometry or feel of outer surfaces 26 and 56, are obtained during the molding process. The desired texture is added to those portions of the cavity and core corresponding to outer surface 46 and outer surfaces 26 and 56. Alternatively, the texture, surface geometry or feel of outer surface 46 can be obtained by a secondary process after nipple 10 is molded. In this embodiment, the rough texture of outer surface 46 can be obtained by texturing that portion of the cavity and core corresponding to outer surface 46 by electrical discharge machining, chemical etching, or any other known machining or texturing method. The portion of the cavity and core corresponding to outer surface 26 of stem 20 and outer surface 56 of bulbous region 50 can be polished to a smooth or fine finish to provide for a smooth texture, surface geometry or feel of outer surfaces 26 and 56.

Areola region 45 is connected to, and surrounded by, bulbous region 50 along areola edge 47. Preferably, areola edge 47 is circular. More preferably, areola edge 47 has a diameter of about 1.20 inches to about 1.80 inches. Most preferably, areola edge 47 has a diameter of about 1.40 inches to about 1.50 inches. Areola region 45 is preferably integrally molded or formed with bulbous region 50 along areola edge 47.

Bulbous region 50 is designed to simulate the region of a woman's breast that surrounds the areola region. Bulbous region 50 has an outwardly curved or convex shape. In the preferred embodiment, the surface area of bulbous region 50 is greater than the surface area of areola region 45.

Figure 7:
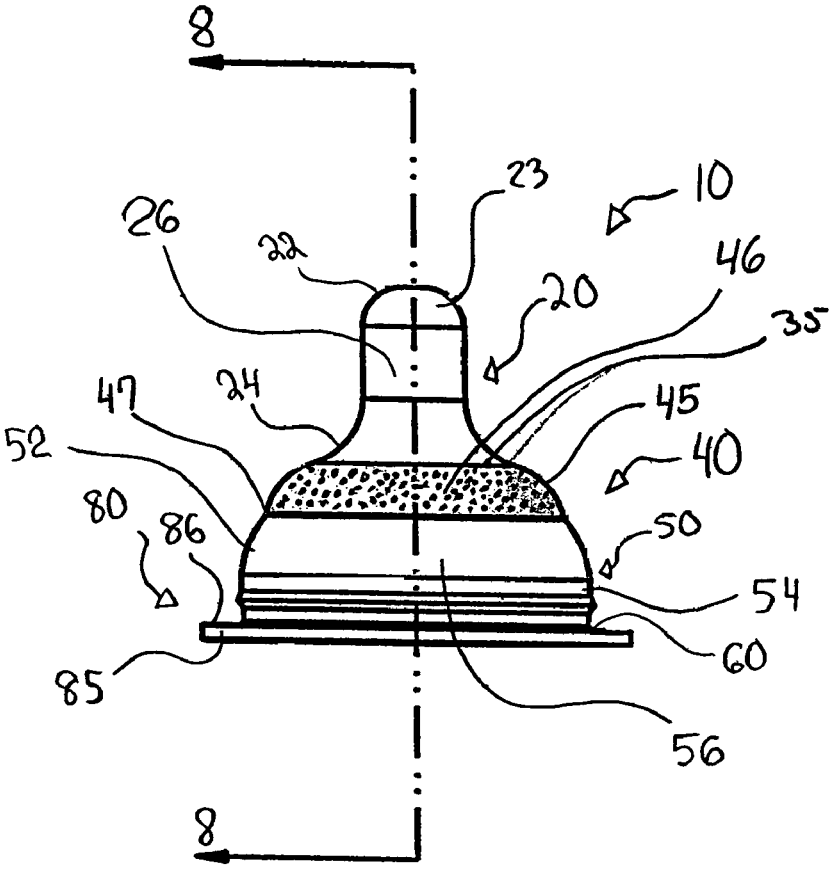
FIG. 7 is a plan view of the nipple of FIG. 4.
Figure 6:
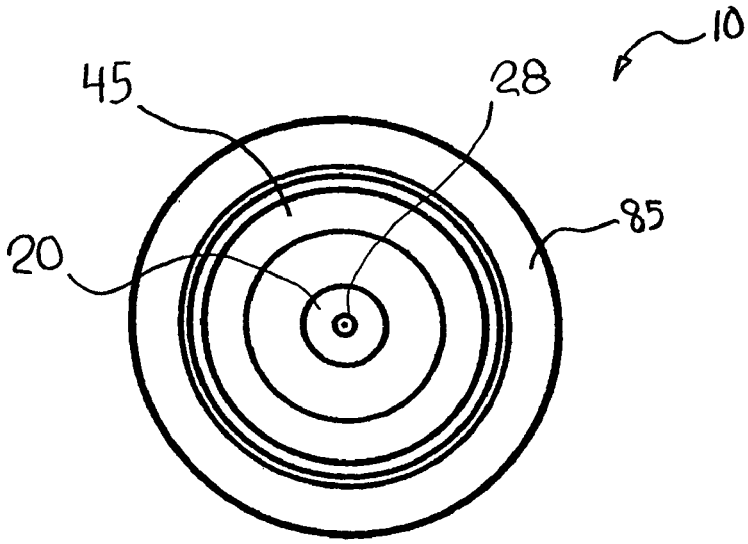
FIG. 6 is a bottom view of the nipple of FIG. 4.
Figure 8:
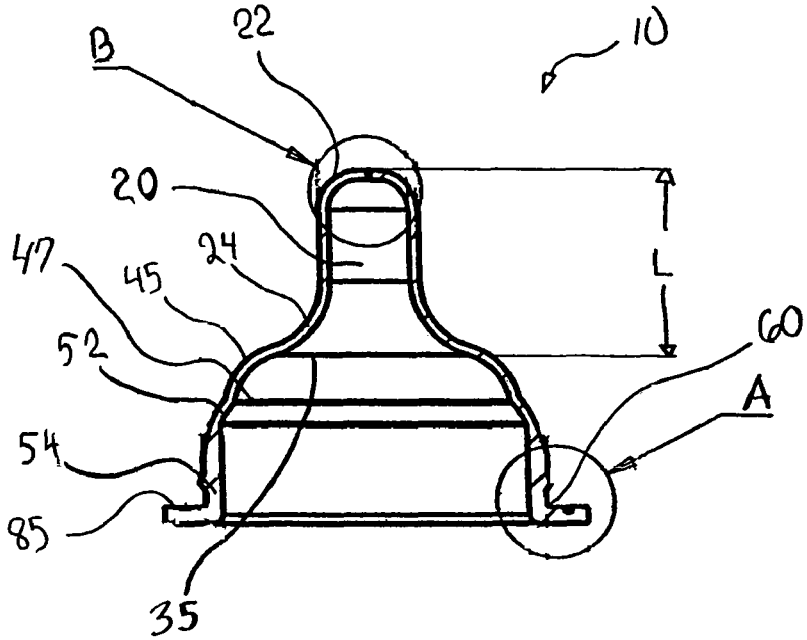
FIG. 8 is a cross sectional view of the nipple of FIG. 7 taken along line 8-8.
Figure 9:
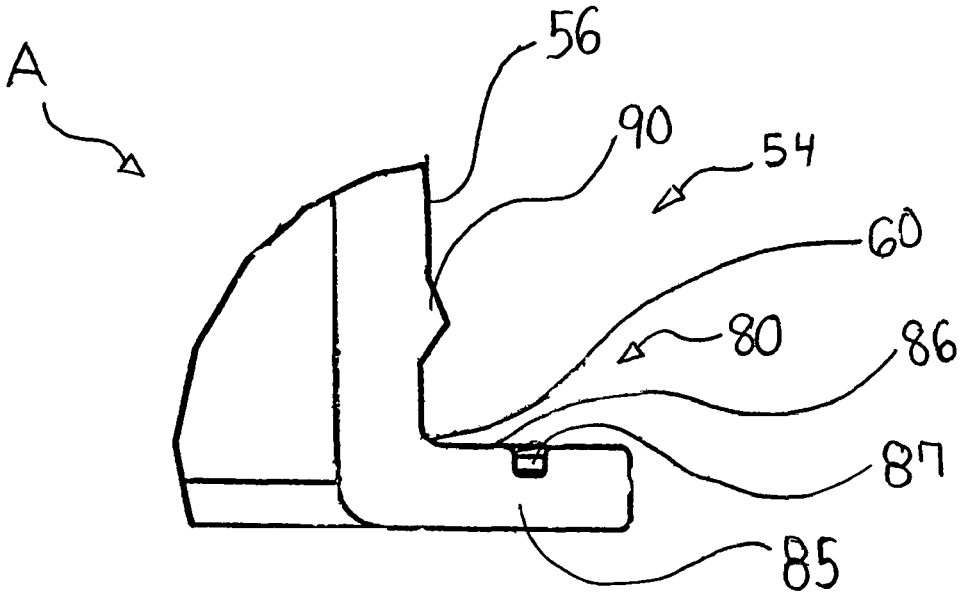
FIG. 9 is an enlarged view of portion A of FIG. 8.
Figure 10:
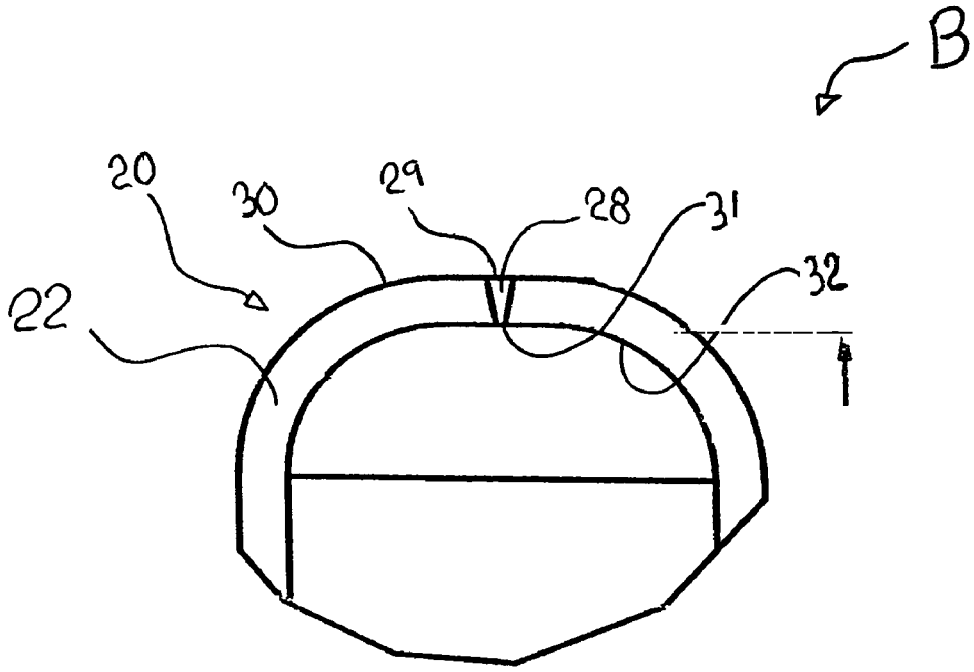
FIG. 10 is an enlarged view of Portion B of FIG. 8.

Referring to FIGS. 7 through 9, bulbous region 50 comprises an upper portion 52 and a lower portion 54. Upper portion 52 extends curvingly downward from areola edge 47 to form an outwardly convex or raised shape. Preferably, upper portion 52 has a radius of curvature of about 0.25 inches to about 0.75 inches. More preferably, upper portion 52 has a radius of curvature of about 0.50 inches to about 0.60 inches. Lower portion 54 extends substantially vertically downward from upper portion 52. By providing outer surface 56 of bulbous region 50 with a smooth surface, as well as upper portion 52 of the bulbous region with an outwardly convex shape, the baby will more easily slide back onto areola region 45 for proper latch on.

Preferably, upper portion 52 has a wall thickness that is thinner than the wall thickness of lower portion 54. Lower portion 54 preferably has a wall thickness of about 0.03 inches to about 0.25 inches. More preferably, lower portion 54 has a wall thickness of about 0.08 inches to about 0.11 inches.

Bulbous region 50 is connected to, and surrounded by, securing structure 80 along bulbous edge 60. Bulbous edge 60 is preferably circular. Preferably, bulbous edge 60 has a diameter of about 1.50 inches to about 2.00 inches. More preferably, bulbous edge 60 has a diameter of about 1.70 inches to about 1.80 inches. Bulbous region 50 is preferably integrally formed with securing structure 80 along bulbous edge 60.

Securing structure 80 has a flange 85 with an upper surface 86. Flange 85 extends outwardly from bulbous edge 60 and is preferably circular in shape. More preferably, flange 85 is perpendicular to outer surface 56 of lower portion 54. Preferably, flange 85 is integrally formed with and surrounds bulbous edge 60. Flange 85 preferably extends from bulbous edge 60 about 0.15 inches to about 0.50 inches. More preferably, flange 85 extends from bulbous edge 60 about 0.20 inches to about 0.25 inches. Flange 85 allows a nipple ring or other securing device to sealingly engage nipple 10 to a baby bottle (not shown) through a downward compression force upon upper surface 86 of the flange against a rim or leading edge of the baby bottle.

Flange 85 preferably has a securing channel 87 formed in upper surface 86. Securing channel 87 is an annular channel or groove on upper surface 86 of flange 85. Securing channel 87 can be used for locking and sealing flange 85 to a nipple ring or other securing device that has an annular rib (not shown) aligned with and over the securing channel. Preferably, securing channel 87 has a width of about 0.02 inches to about 0.05 inches, and a height of about 0.02 inches to about 0.05 inches.

Lower portion 54 of bulbous region 50 has a locking ring 90. Locking ring 90 is an annular ring extending outwardly from lower portion 54. Preferably, locking ring 90 is integrally formed or molded with lower portion 54. Locking ring 90 is preferably parallel to flange 85 so that the distance between the locking ring and the flange is the same along the entire circumference of lower portion 54. In this embodiment, locking ring 90 is triangular in shape but alternative shapes can be used, such as, for example, a semi-circular ring. Locking ring 90 provides an engagement structure or locking structure between nipple 10 and the nipple ring (not shown) so that the nipple and nipple ring can remain assembled while removed from the baby bottle.

Nipple 10 is preferably made of a flexible, resilient material. More preferably, nipple 10 is made from silicone, latex, or other rubber materials. This material provides flexibility to nipple 10 that further simulates the function of a woman's breast during breast-feeding.

For example, nipple 10 can be positioned between a nipple ring having a concentric hole, internal threads and an annular ring on its lower surface (not shown), and a baby bottle having external threads on its top (not shown). The nipple ring can then be threadingly secured to the baby bottle causing a compressive force to be exerted on upper surface 86 of flange 85 by the nipple ring and leading edge or rim of the baby bottle. Securing channel 87 engages with the annular ring on the lower surface of the nipple ring (not shown) providing a further locking and sealing mechanism.

During breast-feeding, a baby latches on to the areola region of a woman's breast. The present invention provides areola region 45 on nipple 10 for a baby to latch on to during bottle feeding. Areola region 45 is a raised or outwardly convex surface that facilitates latch on by the baby and promotes a more secure engagement for the baby, which reduces air leakage into nipple 10 or liquid leakage from the nipple. Conventional nipples, including the nipple disclosed in U.S. Pat. No. 5,653,732, fail to provide a single, distinct area that simulates the areola of a woman's breast. In providing areola region 45, the present invention provides nipple 10 that simulates a woman's breast during breast-feeding and reduces the difficulties associated with switching between breast-feeding and bottle-feeding.

Additionally, during breast-feeding, the areola of a woman's breast is pulled by the sucking force, resulting in inward and outward movement in the baby's mouth. The present invention further provides areola region 45 and upper portion 52 having thinner walls than lower portion 54. This provides a flexible region that causes areola region 45 of nipple 10 to have flexibility similar to that of a woman's breast when a sucking force is applied.

The present invention having been thus described with particular reference to the preferred forms thereof, it will be obvious that various changes and modifications may be made therein without departing from the spirit and scope of the present invention as defined in the appended claims.

What is claimed is:

1. A nipple comprising:

a stem having a stem surface with a first surface geometry, said stem having a proximal end and a distal end, said distal end including a curved apex surface prior to use, said stem being inwardly tapered from said proximal end toward said curved apex surface;

an areola region having an areola surface with a second surface geometry, said areola region having an outwardly curved shape; and a bulbous region having a bulbous surface with a third surface geometry, said bulbous region having an outwardly curved shape, and said areola region being disposed between said stem and said bulbous region.

2. The nipple of claim 1, wherein said areola has an areola radius of curvature and said bulbous region has a bulbous radius of curvature, and wherein said areola radius of curvature is different than said bulbous radius of curvature.

3. The nipple of claim 2, wherein said areola radius of curvature is less than said bulbous radius of curvature.

4. The nipple of claim 1, wherein at least a portion of said second surface geometry is different from at least a portion of said third surface geometry.

5. The nipple of claim 1, wherein said second surface geometry is formed from a process chosen from the group consisting essentially of chemical etching, electrical discharge, machining, and any combinations thereof.

6. The nipple of claim 1, wherein said first surface geometry is smooth.

7. The nipple of claim 1, wherein said third surface geometry is smooth.

8. The nipple of claim 1, wherein said bulbous region simulates the shape, surface geometry and function of a region of the woman's breast surrounding the areola.

9. The nipple of claim 1, wherein said stem, said areola region and said bulbous region are formed from continuous flexible material.

10. The nipple of claim 9, wherein said flexible material is chosen from the group consisting essentially of silicone, latex, rubber, and any combinations thereof.

11. The nipple of claim 1, wherein said areola region has a radius of curvature of about 0.25 inches to about 0.50 inches.

12. The nipple of claim 1, wherein said bulbous region has a radius of curvature of about 0.25 inches to about 0.75 inches.

13. The nipple of claim 1, further comprising a securing structure connected to said bulbous region.

14. The nipple of claim 13, wherein said securing structure is a flange extending outwardly from said bulbous region.

15. The nipple of claim 14, wherein said flange has an annular channel formed therein.

16. The nipple of claim 1, wherein said areola surface has an indiscrete rough texture.

17. The nipple of claim 1, wherein said stem has a length of about 0.50 inches to about 1.25 inches.

18. The nipple of claim 1, wherein said stem is tapered.

19. A nipple comprising:

a stem having a stem surface with a first surface geometry, said stem having a proximal end and a distal end, said distal end including a curved apex surface prior to use, said stem being inwardly tapered from said proximal end toward said curved apex surface;

an areola region having an areola surface with a second surface geometry, said areola region having an outwardly curved shape; and a bulbous region having a bulbous surface with a third surface geometry, said bulbous region having an outwardly curved shape, said areola region being disposed between said stem and said bulbous region, wherein at least a portion of said second surface geometry is different from at least a portion of said first surface geometry.

20. The nipple of claim 19, wherein said areola region and said bulbous region have an outwardly curved shape, and wherein said areola region has a second radius of curvature and said bulbous region has a third radius of curvature different than said second radius of curvature.

21. The nipple of claim 19, wherein at least a portion of said second surface geometry is different from at least a portion of said third surface geometry.

22. The nipple of claim 21, wherein said third surface geometry is smooth.

23. The nipple of claim 21, wherein said second surface geometry is dimpled.

24. The nipple of claim 21, wherein said first surface geometry is smooth.

25. The nipple of claim 19, wherein said second surface geometry is formed from a process chosen from the group consisting essentially of chemical etching, electrical discharge, machining, and any combinations thereof.

26. The nipple of claim 19, wherein said stem, said areola region and said bulbous region are integrally formed from a flexible material.

27. The nipple of claim 26, wherein said flexible material is chosen from the group consisting essentially of silicone, latex, rubber, and any combinations thereof.

28. The nipple of claim 19, wherein said areola region has a radius of curvature is about 0.25 inches to about 0.50 inches.

29. The nipple of claim 19, wherein said bulbous region has a radius of curvature is about 0.25 inches to about 0.75 inches.

30. The nipple of claim 19, further comprising a securing structure connected to said bulbous region.

31. The nipple of claim 30, wherein said securing structure is a flange extending outwardly from said bulbous region.

32. The nipple of claim 31, wherein said flange has an annular channel formed therein.

33. The nipple of claim 19, wherein said stem has a length of about 0.50 inches to about 1.25 inches.

34. The nipple of claim 19, wherein said stem is tapered.

35. A nipple comprising:

a stem region having smooth texture, said stem having a proximal end and a distal end, said distal end including a curved apex surface prior to use, said stem being inwardly tapered from said proximal end toward said curved apex surface;

an areola region having an outer surface comprising a rough texture, said areola region having an outwardly curved shape; and a third region having a smooth texture, said third region having an outwardly curved shape, and said areola region being disposed between said stem and third regions.

36. The nipple of claim 35, wherein said rough texture is formed from a process chosen from the group consisting of chemical etching, electrical discharge, machining, and any combinations thereof.

37. The nipple of claim 35, wherein said rough texture is formed during molding of the nipple.

38. The nipple of claim 35, wherein said outer surface of said areola region further comprises a plurality of dimples.

39. The nipple of claim 35, wherein said outer surface of said areola region further comprises a plurality of ribs.

* * * * *